US010224140B2

(12) United States Patent
Janis et al.

(10) Patent No.: US 10,224,140 B2
(45) Date of Patent: Mar. 5, 2019

(54) INTEGRATED MULTI-PHASE POWER INDUCTOR WITH NON-COUPLED WINDINGS AND METHODS OF MANUFACTURE

(71) Applicant: EATON INTELLIGENT POWER LIMITED, Dublin (IE)

(72) Inventors: John J. Janis, Oxford, GA (US); Yipeng Yan, Shanghai (CN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 238 days.

(21) Appl. No.: 15/054,727

(22) Filed: Feb. 26, 2016

(65) Prior Publication Data

US 2017/0178784 A1 Jun. 22, 2017

Related U.S. Application Data

(63) Continuation of application No. PCT/CN2015/098192, filed on Dec. 22, 2015.

(51) Int. Cl.
*H01F 27/29* (2006.01)
*H01F 27/24* (2006.01)
(Continued)

(52) U.S. Cl.
CPC ..... *H01F 27/24* (2013.01); *H01F 17/06* (2013.01); *H01F 27/28* (2013.01);
(Continued)

(58) Field of Classification Search
CPC ..... H01F 27/027; H01F 27/292; H01F 38/12; H01F 5/04; H01F 27/28; H01F 5/00
(Continued)

(56) References Cited

U.S. PATENT DOCUMENTS 4,550,364 A * 10/1985 Shaw ..... H01F 19/08 336/212
5,568,111 A * 10/1996 Metsler ..... H01F 27/29 333/185
(Continued)

FOREIGN PATENT DOCUMENTS

CN 103489576 A 1/2014
CN 104051128 A 9/2014
(Continued)

OTHER PUBLICATIONS

International Search Report and Written Opinion of International Application No. PCT/CN2015/098192, dated Sep. 27, 2016, 11 pages.

*Primary Examiner* — Tszfung J Chan
(74) *Attorney, Agent, or Firm* — Armstrong Teasdale LLP

(57) ABSTRACT

A surface mount power inductor component for a circuit board including multi-phase power supply circuitry includes a single piece, integrally fabricated magnetic core piece formed with vertically extending interior passageways provided with vertically elongated pre-formed conductive windings that are not magnetically coupled to reduce the footprint of the inductor component while increasing its power capacity. A distributed gap material is also provided in the vertical passageways with the conductive windings that respectively connect to each phase of electrical power.

19 Claims, 6 Drawing Sheets

(51) Int. Cl.
*H01F 27/28* (2006.01)
*H01F 41/02* (2006.01)
*H01F 41/04* (2006.01)
*H01F 17/06* (2006.01)

(52) U.S. Cl.
CPC ..... *H01F 27/2847* (2013.01); *H01F 27/292* (2013.01); *H01F 41/0233* (2013.01); *H01F 41/04* (2013.01); *H01F 2017/067* (2013.01)

(58) Field of Classification Search
USPC ..... 336/65, 83, 90, 192, 200, 232
See application file for complete search history.

(56) References Cited

U.S. PATENT DOCUMENTS 5,731,666 A * 3/1998 Folker ..... H05B 41/28 315/276
6,414,582 B1 * 7/2002 Brkovic ..... H01F 38/023 336/185
7,218,199 B1 5/2007 Chang
8,179,116 B2 * 5/2012 Wei ..... H02M 3/156 323/224
8,299,885 B2 * 10/2012 Ikriannikov ..... H01F 17/0006 336/212
8,890,644 B2 * 11/2014 Ikriannikov ..... H01F 17/06 336/192
2006/0290458 A1 * 12/2006 Sano ..... H01F 3/12 336/212
2007/0216512 A1 * 9/2007 Sano ..... H01F 17/043 336/212
2008/0001693 A1 * 1/2008 Hahn ..... H01F 3/12 336/83
2011/0121929 A1 * 5/2011 Lo ..... H01F 3/14 336/90
2013/0207764 A1 * 8/2013 Yeh ..... H01F 27/292 336/65
2017/0011836 A1 * 1/2017 Ma ..... H01F 27/255

FOREIGN PATENT DOCUMENTS

CN 104282411 A 1/2015
CN 204680522 U * 9/2015
JP 05258959 A * 10/1993
JP 05283233 A * 10/1993
JP 06061055 A * 3/1994

* cited by examiner

INTEGRATED MULTI-PHASE POWER INDUCTOR WITH NON-COUPLED WINDINGS AND METHODS OF MANUFACTURE

CROSS REFERENCE TO RELATED APPLICATIONS

This application is a continuation application of International Application No. PCT/CN2015/098192.

BACKGROUND OF THE INVENTION

The field of the invention relates generally to electromagnetic inductor components, and more particularly to a power inductor component for circuit board applications including at least two windings that are not magnetically coupled.

Power inductors are used in power supply management applications and power management circuitry on circuit boards for powering a host of electronic devices, including but not necessarily limited to hand held electronic devices. Power inductors are designed to induce magnetic fields via current flowing through one or more conductive windings, and store energy via the generation of magnetic fields in magnetic cores associated with the windings. Power inductors also return the stored energy to the associated electrical circuit by inducing current flow through the windings. Power inductors may, for example, provide regulated power from rapidly switching power supplies in an electronic device. Power inductors may also be utilized in electronic power converter circuitry.

Power inductors are known that include multiple windings integrated in a common core structure. Existing power inductors of this type however, are problematic in some aspects and improvements are desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
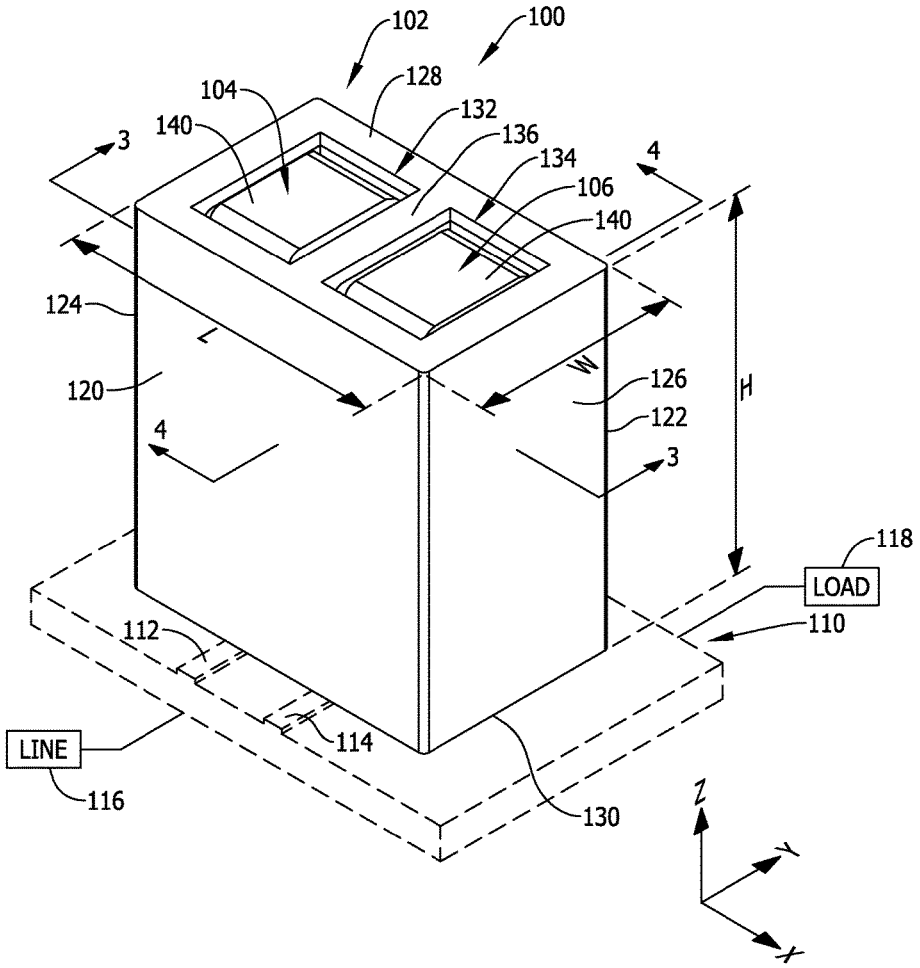
FIG. 1 is a top perspective view of a first exemplary embodiment of a surface mount, power inductor component assembly.

As mentioned above, electromagnetic power inductors are known that include, for example, multiple windings integrated in a common core structure. Such inductor components are typically beneficial to provide multi-phase power regulation at a reduced cost relative to discrete inductor components including separate magnetic cores and windings for each respective phase of electrical power. As one example, a two phase power system can be regulated with an integrated power inductor component including two windings in the same magnetic core. One winding is connected to the first power phase of electrical circuitry on a circuit board, and the other winding is connected to the second power phase of electrical circuitry on a circuit board. The integrated windings on a single core structure typically saves valuable space on the circuit board relative to providing one discrete inductor component for each phase including its own magnetic core. Such space savings can contribute to a reduction in size of the circuit board and also the electronic device including the circuit board.

Known integrated multi-phase power inductor component constructions are limited, however, in certain aspects and are therefore undesirable for application in certain types of electrical power systems. As such, existing power inductor constructions have yet to fully meet the needs of the marketplace in certain aspects.

For example, in multi-phase power supply applications, inductance unbalance issues between different phases connected to each winding can be problematic, and thus achieving balanced performance can be particularly difficult for smaller components in higher power, higher current applications that modern day electrical devices demand.

Also, the manufacture and assembly of known integrated multi-phase power inductor components tends to involve multiple core pieces and fabrication steps to construct the magnetic core, including but not limited to steps associated with bonding of the multiple core pieces that increase the cost of manufacture and assembly for the components.

Saturation current ($I_{sat}$) performance tends to be limited by the core construction in known integrated multi-phase power inductor components. Improvement is desired for state of the art electrical power systems for higher powered electronic devices.

The form factor of known integrated multi-phase power inductor components, including the "footprint" (understood by those in the art as a reference to an area that the component occupies on a plane of the circuit board) and profile (understood by those in the art as a reference to the overall component height measured perpendicular to the plane of the circuit board) can effectively limit the ability of the component to perform in higher current, higher power system applications. Balancing the power demands of higher power circuitry with a desire for ever-smaller components is a challenge.

Finally, alternating current resistance (ACR) caused by fringing effect of integrated multi-phase power inductor component in use can be undesirably high in known component constructions.

Exemplary embodiments of integrated electromagnetic multi-phase power inductor component assemblies for power supply circuitry on a circuit board (i.e., power inductors) are described hereinbelow that overcome at least the disadvantages described above. The exemplary inductor component assemblies achieve this at least in part via a single piece magnetic core that eliminates any need to bond separately fabricated, discrete core pieces together and therefore simplifies assembly of the component and lowers manufacturing cost. Distributed gap material is employed to reduce, if not minimize, fringing flux from conventionally employed discrete air gaps in the core structure, and ACR caused by fringing effect is accordingly reduced. Higher power capability is provided with three dimensional conductive windings formed from planar conductive material and core structure that has a relatively small footprint in combination with a relatively taller profile to accommodate higher power, higher current applications.

Figure 2:
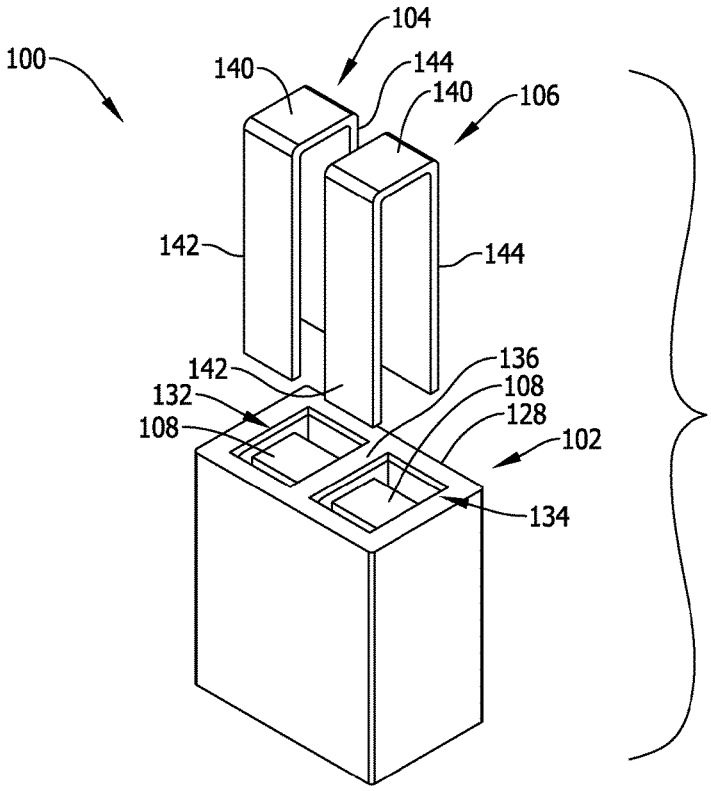
FIG. 2 is an exploded view of the power inductor component assembly shown in FIG. 1.
Figure 3:
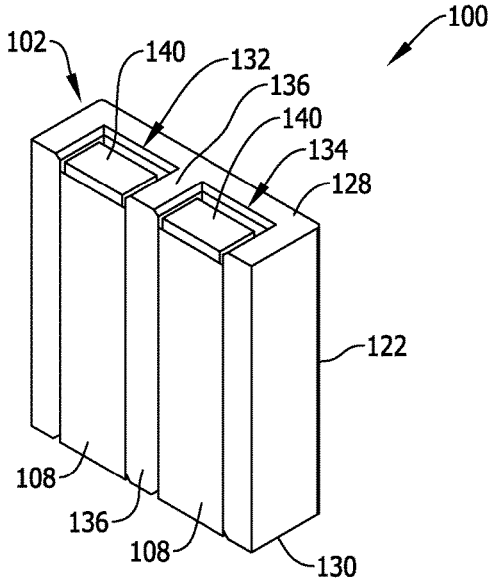
FIG. 3 is a first sectional view of the power inductor component assembly shown in FIG. 1 along 3-3.
Figure 4:
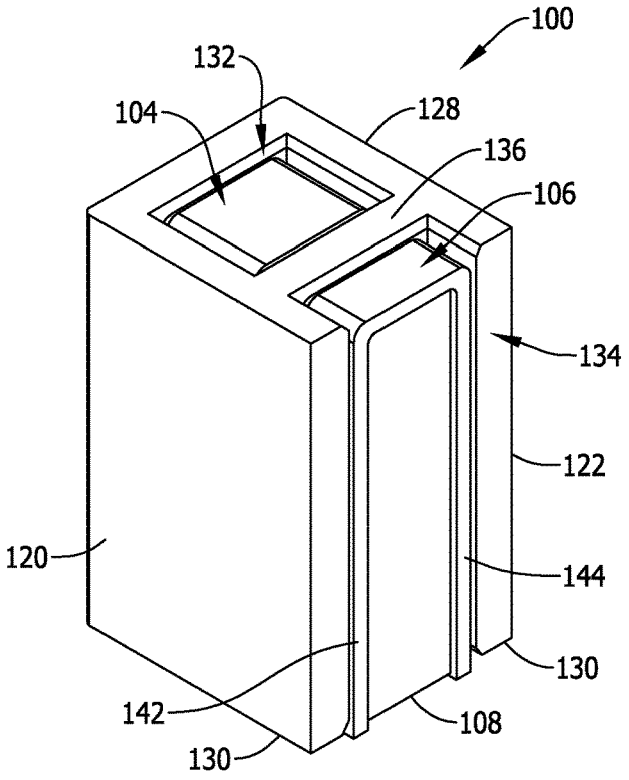
FIG. 4 is a second sectional view of the power inductor component assembly shown in FIG. 1 along 4-4.
Figure 5:
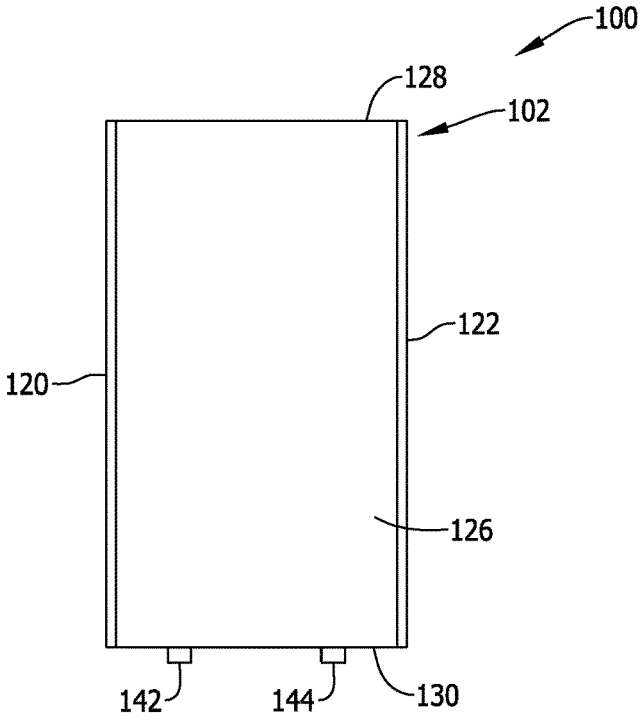
FIG. 5 is a lateral side elevational view of the power inductor component assembly shown in FIGS. 1 and 2.
Figure 6:
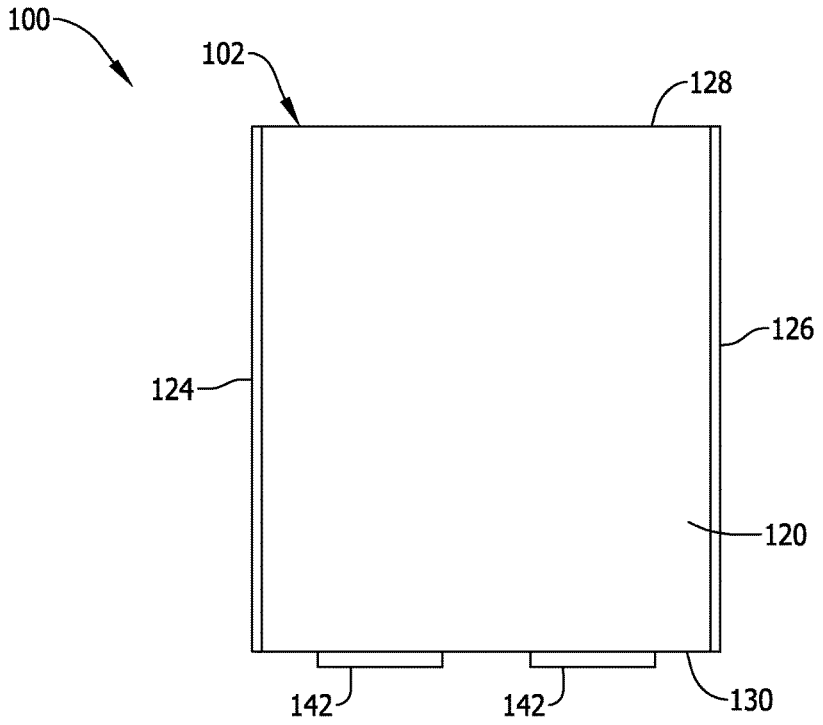
FIG. 6 is a longitudinal side elevational view of the power inductor component assembly shown in FIGS. 1 and 2.
Figure 7:
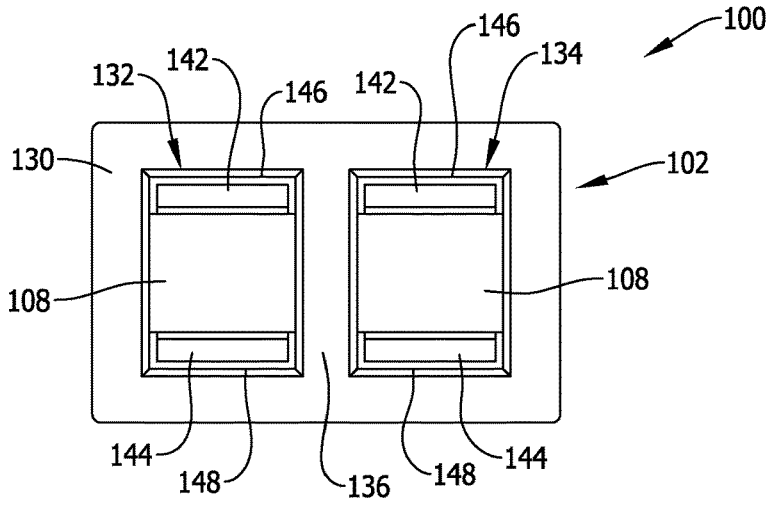
FIG. 7 is a bottom view of the power inductor component assembly shown in FIGS. 1 and 2.

FIG. 1-7 illustrate various views of a first exemplary embodiment of a surface mount, power inductor component assembly 100. FIG. 1 shows the power inductor component assembly 100 in perspective view. FIG. 2 is an exploded view of the power inductor component assembly 100. FIG. 3 is a first sectional view of the power inductor component assembly 100 taken along line 3-3 in FIG. 1. FIG. 4 is a second sectional view of the power inductor component assembly 100 taken along line 4-4 in FIG. 1. FIG. 5 is a lateral side elevational view of the power inductor component assembly 100. FIG. 6 is a longitudinal side elevational view of the power inductor component assembly 100. FIG. 7 is a bottom view of the power inductor component assembly 100.

The power inductor component assembly 100 generally includes, as shown in FIG. 1, a magnetic core piece 102 with integrated conductive windings 104 and 106 respectively arranged in the magnetic core piece 102 around a distributed gap magnetic material 108 (FIGS. 2-4), and a circuit board 110.

The circuit board 110 is configured with multi-phase power supply circuitry, sometimes referred to as line side circuitry 116, including conductive traces 112, 114 provided on the plane of the circuit board in a known manner. In the example shown, the line side circuitry 116 provides two phase electrical power, and in contemplated embodiments the first conductive trace 112 corresponds to a first phase of the multi-phase power supply circuitry and the second conductive trace 114 corresponds to the second phase of the multi-phase power supply circuitry. In turn, the first conductive winding 104 is connected to the first conductive trace 112 and the first phase and the second conductive winding 106 is connected to the second conductive trace 114 and the second phase of the multi-phase power supply circuitry. While a two phase power system is represented and the inductor component is configured as a dual inductor having two windings 104 and 106, greater or fewer numbers of phases in the multi-phase power supply circuitry may alternatively be provided, and a corresponding number of windings to the phases provided may be included in the magnetic core piece 102. That is, the component may be configured for single phase power application and include a single winding, or may include three, four or more windings for power systems including three or more phases.

It is understood that more than one inductor component including the core piece 102 and windings 104 and 106 may be provided on the board 110 as desired. Other types of circuit components may likewise be connected to the circuit board 110 to complete, for example, a power regulator circuit and/or a power converter circuit on the board 110. As such power regulator and converter circuits are generally known and within the purview of those in the art, no further description of the circuitry is believed to be necessary. While not seen in FIG. 1, circuit traces are also included on the circuit board 110 on the other side of the power inductor component illustrated to establish electrical connection to load side circuitry 118 downstream from the conductive windings 104, 106 in the circuitry.

The magnetic core piece 102 in an exemplary embodiment is fabricated as a single piece, integrally formed magnetic core using known magnetic materials and techniques. Fabrication of the core piece 102 as a single piece avoids process steps of having to assemble separate and discrete core pieces common to some known types of power inductors.

In contemplated embodiments, the magnetic core piece 102 may be formed from soft magnetic particle materials utilizing known techniques such as molding of granular magnetic particles to produce the desired shape as shown and including the features further described below. Soft magnetic powder particles used to fabricate the core piece 102 may include Ferrite particles, Iron (Fe) particles, Sendust (Fe—Si—Al) particles, MPP (Ni—Mo—Fe) particles, HighFlux (Ni—Fe) particles, Megaflux (Fe—Si Alloy) particles, iron-based amorphous powder particles, cobalt-based amorphous powder particles, and other suitable materials known in the art. Combinations of such magnetic powder particle materials may also be utilized if desired. The magnetic powder particles may be obtained using known methods and techniques and molded into the desired shape also using known techniques.

In the example shown, the magnetic core piece 102 is formed with opposing first and second longitudinal side walls 120 and 122, opposing first and second lateral side walls 124 and 126 interconnecting the first and second longitudinal side walls 120 and 122, and opposing top and bottom walls 128 and 130 interconnecting the respective first and second longitudinal side walls 120 and 122 and the respective first and second lateral side walls 124 and 126. In the context of FIG. 1, the "bottom" side wall 130 is located adjacent the circuit board 110 and the "top" wall 128 is located at some distance from the circuit board 110.

The magnetic core piece 102 including the generally orthogonal side walls 120, 122, 124, 126, 128 and 130 impart an overall rectangular or box-like shape and appearance of the core piece 102. The box-like shape of the core piece 102 in the illustrated example has an overall length L measured between the side walls 124, 126 and along a first dimensional axis such as an x axis of a Cartesian coordinate system. The core piece 102 also has a width W measured between the side walls 120 and 122 along a second dimensional axis perpendicular to the first dimension axis such as ay axis of a Cartesian coordinate system, and a height H measured between the top and bottom walls 128 and 130 along a third dimensional axis extending perpendicular to the first and second dimensional axis such as a z axis of a Cartesian coordinate system.

The dimensional proportions of the core piece 102 runs counter to recent efforts in the art to reduce the height dimension H to produce as low profile components as possible. In higher power, higher current circuitry, as the height dimension H is reduced per recent trends in the art, the dimension W (and perhaps L as well) tends to increase to accommodate coil windings capable of performing in higher current circuitry. As a result, and following this trend, a reduction in the height dimension H tends to increase the width W or length L and therefore increase the footprint of the component on the board 110. The assembly 100 of the present invention, however, favors an increased height dimension H (and increased component profile) in favor of a smaller footprint on the board 110. As seen in the example of FIG. 1, the dimensions L and H are both much greater than the dimension W. Component density on the circuit board 110 may accordingly be increased by virtue of the smaller footprint of the component on the circuit board 110.

As seen in FIG. 1, a portion of each of the coil windings 104 and 106 are each exposed on the top wall 128 in a slightly recessed manner from the top wall 128 of the magnetic core piece 102. The exposed coil windings 104 and 106 are relatively large in the x, y plane to capably handle higher current, higher power applications beyond the limits of conventional electromagnetic component constructions of an otherwise similar size.

The magnetic core piece 102 is further formed with a first elongated interior passageway 132 and a second elongated interior passageway 134 that each extend end-to-end between the opposing top and bottom side walls 128 and 130. The passageways 132, 134 are spaced from each of the side walls 120, 122, 124 and 126 and extend "interior" to the magnetic core piece 102 from this perspective. In the example illustrated, the side walls 120, 122, 124 and 126 are each solid and do not include openings. The fabrication of the core piece 102 is therefore simplified relative to more complicated core shapes and assemblies including physical gaps, openings, and the like and the core piece 102 may accordingly be provided at a relatively lower cost.

The interior passageways 132, 134 extend completely through the core piece 102 in a direction perpendicular to the top and bottom walls 128, 130 and also to the plane of the circuit board 110. Each passageway 132, 134 is shaped as a generally elongated rectangle in cross section, and are each seen in the drawings to include four orthogonal side edges that are complementary in shape to the exposed portion of the windings 104 and 106. The first and second interior passageways 132, 134 in the example shown are accessible from the top wall 128 and bottom wall 130 as further seen in the views of FIGS. 2, 3, 4 and 7. The first and second interior passageways 132, 134 further extend side-by-side in the core piece 102 and are separated from one another by a partition wall 136 formed in the core piece 102. The core piece 102 in the configuration shown bears a resemblance to a concrete block from the top, albeit one with an elongated height.

As best shown in FIG. 2, each of the conductive windings 104 and 106 are formed as identically shaped and fabricated elements. Each winding 104, 106 is fabricated from a thin strip of conductive material that is bent or otherwise shaped or formed into the geometry shown. In the illustrated example, each winding 104, 106 includes a planar winding section 140 exposed on the top side 128 of the core piece 102 (FIG. 1) and first and second planar legs 142, 144 each extending perpendicular to the planar winding section 140 and opposing one another. As such, and in the illustrated example, the windings 104 and 106 are generally inverted U-shaped members with the section 140 being the base of the U and the legs 142, 144 extending downward from the section 140 in the core piece 102 in each passageway 132, 134.

In the example shown, the legs 142, 144 are disproportionately longer that the section 140 along an axis of the winding. That is, the legs 142, 144 have a first axial length that is much larger than the axial length of the winding section 140. For example, the axial length of the legs 142, 144 may be about three times the axial length of the section 140, although this is not strictly necessary in all embodiments. The proportions of the windings 104, 106 facilitate a reduced footprint of the completed inductor component on the circuit board 110 as explained above, and the increased height of the windings 104, 106 provides a winding of sufficient length to capably handle higher current in a higher power electric system on the circuit board 110. The U-shaped windings 104, 106 are rather simply shaped and may be fabricated at low cost from a conductive sheet of material having a desired thickness into the three-dimensional shape as shown. The windings 104, 106 may be fabricated in advance as separate elements for assembly with the core piece 102. That is, the windings 104, 106 may be pre-formed in the shape as shown for later assembly with a core piece 102.

As seen in the Figures, each U-shaped winding 104, 106 is inserted in the respective interior passageways 132, 134 from the top side 128 of the core piece 102. When so inserted, each of the first and second legs 142, 144 in each winding 104, 106 protrudes from the respective interior passageways 132, 134 on the bottom side 130 as seen in FIGS. 4-7. As seen in FIGS. 2, 3, 4 and 7, the distributed gap material 108 extends in each interior passageway 132, 134 and generally occupies an interior of the respective windings 104, 106 between the respective legs 142, 144 and the sections 140.

Unlike the fabricated core piece 102 described thus far, distributed gap magnetic material 108 is fabricated from magnetic powder particles that are coated with an insulating material such that the materials 108 possess so-called distributed gap properties familiar to those in the art and fabricated in a known manner. As such, in contemplated embodiments, the core piece 102 does not possess distributed gap properties, while the material 108 does. In one embodiment, the distributed gap material 108 may be applied in the passageways 132, 134 in a known manner before or after the windings 104, 106 are received in the passageways 132, 134.

Specifically, the core piece 102 can be formed in a first molding stage with magnetic material that does not include distributed gap properties, and the distributed gap material 108 can be provided in a second molding stage after the remainder of the core piece 102 is formed in a contemplated embodiment. The core piece 102, including the distributed gap material 108, may therefore be provided for assembly with the windings 104, 106.

Alternatively, the distributed gap material 108 may first be formed in the desired shape as seen in the drawings and further described below, with the core piece 102 overmolded around the material 108. The core piece 102 including the distributed gap material 108 may then be provided for assembly with the windings 104, 106.

As another alternative, the windings 104, 106 may be pre-formed and overmolded with the distributed gap material 108 in the desired shape as seen in the drawings and further described below, and the core piece 102 overmolded around the windings 104, 106 and the distributed gap materials 108.

Slots 146, 148 may be formed on either side of the distributed gap material 108 in each passageway 132, 134 to receive the legs 142, 144 of the windings 104, 106 as shown in FIG. 7. The slots 146, 148 may be a bit larger than the legs as shown so as to define physical gaps between at least a portion of the legs 142, 144 and interior sidewalls of the passageways 132, 134 as seen in FIG. 7. Also in the example of FIG. 7, the windings 102, 104 may be spaced from the partition wall 136 by a desired amount to create a further physical gap between the windings 104 and 106 and the partition wall 136. The windings 104, 106 are separated from the partition wall 136, and also from one another on opposing sides of the partition wall 136, by an amount sufficient to avoid magnetic coupling of the windings 104, 106 inside the core piece 102. In a multi-phase power inductor application contemplated, magnetic coupling of the windings 104, 106 is undesirable as it may contribute to imbalanced inductance between the respective phases of electrical power.

As seen in FIG. 2, the distributed gap material 108 is recessed from the top wall 128 of the core piece 102, and as seen in FIG. 3 the distributed gap material 108 extends beneath the windings sections 140 as a column of material extending to the bottom wall 130 of the core piece 102. As seen in FIG. 4, the distributed gap material 108 extends between the legs 142, 144 of the windings 104, 106. As seen in FIG. 7, the distributed gap material 108 extends entirely between the partition wall 136 and the opposing interior sidewall of each passageway 132, 134. The distributed gap material 108 extends as a generally rectangular body or post inside each passageway 132, 134. The distributed gap material 108 serves as a guide to facilitate an ease of assembly of the windings 104, 106.

The protruding ends of the legs 142, 144 of each winding 104, 106 from the bottom side 130 of the core piece 102 may be mounted to the circuit board 110 (FIG. 1) using known techniques. No shaping of the protruding ends of the legs 142, 144 is required.

The exemplary inductor component assembly 100 is beneficial in at least the following aspects. The single piece magnetic core 102 eliminates any need to bond separately fabricated, discrete core pieces together and therefore simplifies assembly of the component and lowers manufacturing cost. The component assembly 100 is operable with balanced inductance between the different phases of electrical power connected to each winding while still reliably operating in higher power, higher current applications that modern day electrical devices demand. The distributed gap material 108 reduces, if not minimizes, fringing flux from conventionally employed discrete air gaps in the core structure, and ACR caused by fringing effect is accordingly reduced in operation of the assembly 100. Higher power capability is provided with three dimensional conductive windings 104, 106 formed from planar conductive material and relatively simple core structure that has a relatively small footprint in combination with a relatively taller profile to accommodate higher power, higher current applications. Saturation current ($I_{sat}$) performance is enhanced. The component assembly 100 may be manufactured at relatively low cost, yet offer performance that many conventional power inductors are incapable of delivering.

In some embodiments, the distributed gap material 108 may be pre-formed in the desired shape as discrete core pieces and assembled with the core piece 102 before or after the windings 104, 106 are received in the passageways 132, 134. This would increase the assembly costs, however as it would require bonding of the core pieces to complete the assembly. Nonetheless, at least some of the benefits above may still be realized.

In still another embodiment, the distributed gap material 108 may be applied with the windings 104, 106 in place. The distributed gap material 108 in such an embodiment may be introduced to the passageways as a semi-solid material that is cured in place inside the windings 104, 106 and portions of the passageways 132, 134. This would tend to complicate the assembly, but is possible and may still realize at least some of the performance benefits described above.

Figure 8:
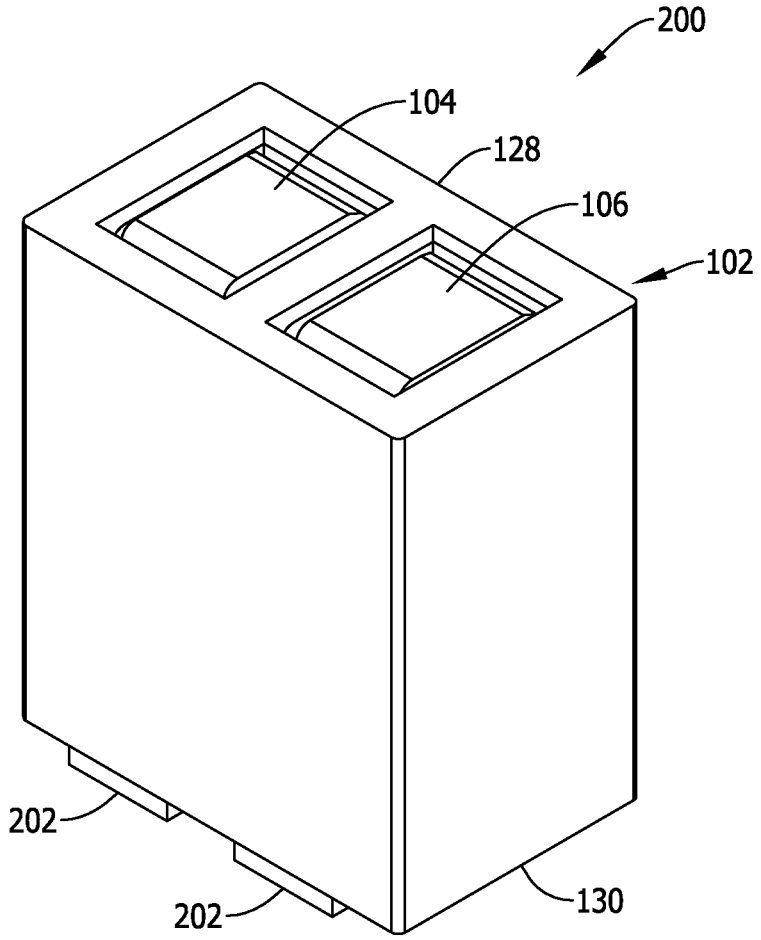
FIG. 8 is a top perspective view of a second exemplary embodiment of a surface mount, power inductor component assembly.
Figure 9:
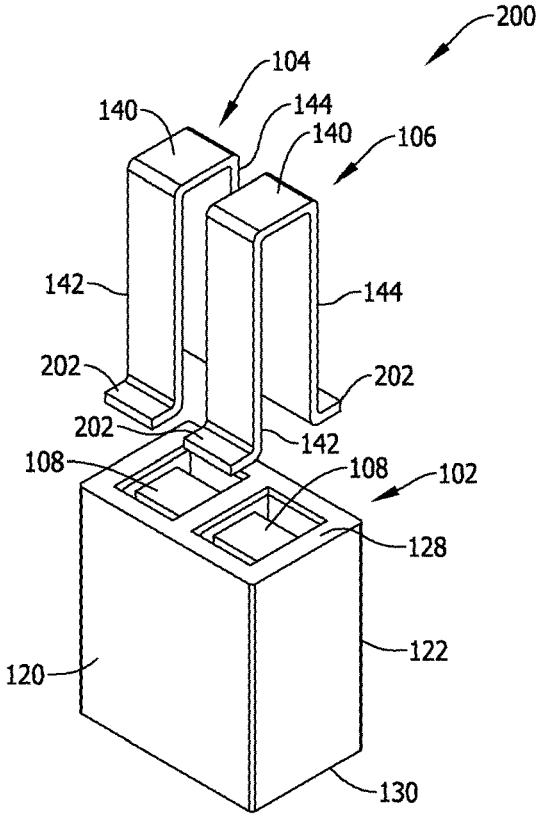
FIG. 9 is an exploded view of the power inductor component assembly shown in FIG. 8.
Figure 10:
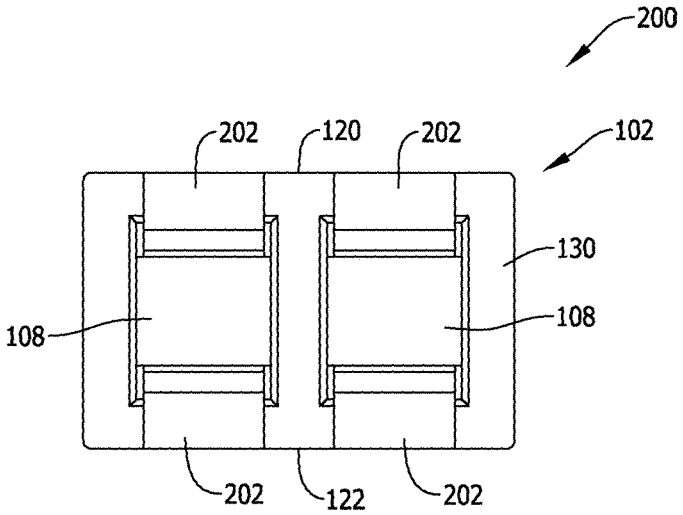
FIG. 10 is a bottom view of the power inductor component assembly shown in FIG. 8.

FIGS. 8-10 are various views of a second exemplary embodiment of a surface mount, power inductor component assembly 200 that may be used in lieu of the assembly 100 on the circuit board 110.

The component assembly 200 is similar to the component assembly 100 except that the ends of the legs 142, 144 in each windings 104, 106 are further formed to include surface mount termination pads 202. The surface mount termination pads 202 extend perpendicularly to the plane of the legs 142, 144, extend generally coplanar to one another on the bottom side wall 130 of the core piece 102, and extend parallel to but in a plane offset from the winding section 140. In each winding, the surface mount termination pads 202 extend in opposite directions from one another and extend to, but not beyond the side walls 120 and 122 of the bottom side wall 130. The footprint of the component on the circuit board 110 is therefore unaffected by the presence of the surface mount termination pads 202.

The surface mount termination pads 202 provide a larger area for surface mounting to the circuit board 110, but the benefits of the component assemblies 100 and 200 are otherwise similar.

The advantages and benefits of the present invention are now believed to have been amply illustrated in relation to the exemplary embodiments disclosed.

An embodiment of an inductor component assembly for power supply circuitry on a circuit board has been disclosed. The inductor component assembly includes a single piece magnetic core. The single piece magnetic core includes opposing first and second longitudinal side walls, opposing first and second lateral side walls interconnecting the first and second longitudinal side walls, and opposing top and bottom sides interconnecting the respective first and second longitudinal side walls and the respective first and second lateral side walls, wherein at least one interior passageway extends between the opposing top and bottom sides.

The inductor component assembly further includes a first conductive winding extending in the at least one interior passageway. The first conductive winding includes a planar winding section exposed on the top side and first and second planar legs each extending perpendicular to the planar winding section and opposing one another. Each of the first and second legs protrude from the at least one interior passageway on the bottom side.

The inductor component assembly further includes a distributed gap magnetic material occupying a portion of the at least one interior passageway at a location beneath the planar winding section and between the first and second legs.

Optionally, the single piece magnetic core in the inductor component assembly may not be fabricated from a distributed gap material. The planar winding section of the first conductive winding may have a first axial length and the first and second planar legs may have a respective second axial length, with the second axial length being substantially greater than the first axis length. The first conductive winding portion may further include first and second planar surface mount termination portions at respective ends of the first and second planar legs opposing the planar winding section. The first and second planar surface mount termination portions may extend coplanar to one another, perpendicular to the respective first and second planar legs, and in opposing directions to one another.

Also optionally, the at least one interior passageway in the single piece magnetic core may include a first interior passageway extending between the opposing top and bottom sides and a second interior passageway extending between the opposing top and bottom sides, and the single piece magnetic core may further include a partition wall extending between the first interior passageway and the second interior passageway. A second conductive winding may occupy the second interior passageway, the second conductive winding being formed substantially identically to the first conductive winding. The second conductive winding may be spaced from the first conductive winding on an opposing side of the partition wall by an amount sufficient to avoid magnetic coupling of the first and second conductive windings when the first and second conductive windings are connected to energized circuitry.

As further options, at least a portion of the first and second planar legs may be physically gapped from the single piece magnetic core at a location interior to the at least one interior passageway in the single piece magnetic core. The inductor component assembly may be in combination with the circuit board, and with the bottom side of the single piece magnetic core located adjacent the circuit board. A height dimension of the single magnetic core piece between the top and bottom sides may be substantially greater than at least one of a width dimension between the first and second longitudinal sides and a length dimension between the first and second lateral sides.

Another embodiment of an inductor component assembly for power supply circuitry on a circuit board has been disclosed. The inductor component assembly includes a single piece magnetic core comprising opposing first and second longitudinal side walls, opposing first and second lateral side walls interconnecting the first and second longitudinal side walls, and opposing top and bottom sides interconnecting the respective first and second longitudinal side walls and the respective first and second lateral side walls, wherein a first interior passageway and a second interior passageway extend between the opposing top and bottom sides and a partition wall extends between the first and second interior passageways. The inductor component assembly also includes a first conductive winding extending in the first interior passageway and a second conductive winding extending in the second interior passageway. Each of the first and second conductive windings are substantially identically formed and include a planar winding section exposed on the top side and first and second planar legs each extending perpendicular to the planar winding section and opposing one another, and each of the first and second legs protrude from the respective first and second interior passageway on the bottom side. A distributed gap magnetic material occupies a portion of the first interior passageway and the second interior passageway at a location beneath the planar winding section and between the first and second legs of each respective first and second conductive windings.

Optionally, the single piece magnetic core is not fabricated from a distributed gap material. The planar winding section of each first and second conductive winding may have a first axial length and the first and second planar legs may have a respective second axial length, with the second axial length being substantially greater than the first axis length. Each of the first and second conductive windings further may include first and second planar surface mount termination portions at respective ends of the first and second planar legs opposing the planar winding section. The first and second planar surface mount termination portions may extend coplanar to one another, perpendicular to the respective first and second planar legs, and in opposing directions to one another. The second conductive winding may be spaced from the first conductive winding on an opposing side of the partition wall by an amount sufficient to avoid magnetic coupling of the first and second conductive windings when the first and second conductive windings are connected to energized circuitry. At least a portion of the first and second planar legs may be physically gapped from the single piece magnetic core at a location interior to each of the first and second passageway. The inductor component assembly may be in combination with the circuit board, and the bottom side of the single piece magnetic core may be located adjacent the circuit board.

A method of fabricating an inductor component assembly for power supply circuitry on a circuit board has also been disclosed. The method includes providing a single piece magnetic core, the single piece magnetic core including opposing first and second longitudinal side walls, opposing first and second lateral side walls interconnecting the first and second longitudinal side walls, and opposing top and bottom walls interconnecting the respective first and second longitudinal side walls and the respective first and second lateral side walls, wherein at least one interior passageway extends between the opposing first and second sides and wherein a height dimension of the single magnetic core piece between the top and bottom sides is substantially greater than at least one of width dimension between the first and second longitudinal sides and the length dimension between the first and second lateral sides. The method further includes extending a first conductive winding in the at least one interior passageway, wherein the first conductive winding includes a planar winding section exposed on the top side and first and second planar legs each extending perpendicular to the planar winding section and opposing one another, each of the first and second legs protruding from the at least one interior passageway on the bottom side. The method also includes applying a distributed gap magnetic material occupying a portion of the at least one interior passageway at a location beneath the planar winding section and between the first and second legs.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An inductor component assembly for power supply circuitry on a circuit board, the inductor component assembly comprising:

a single piece magnetic core that does not possess distributed gap properties, the single piece magnetic core comprising opposing first and second longitudinal side walls, opposing first and second lateral side walls interconnecting the first and second longitudinal side walls, and opposing top and bottom sides interconnecting the respective first and second longitudinal side walls and the respective first and second lateral side walls, wherein at least one interior passageway extends through and between the opposing top and bottom sides in spaced relation from each of the opposing first and second longitudinal side walls and also in spaced relation from each of the opposing first and second lateral side walls;

a first conductive winding extending in the at least one interior passageway, the first conductive winding including a planar winding section exposed on the top side and first and second planar legs each extending perpendicular to the planar winding section and opposing one another, each of the first and second planar legs protruding from the at least one interior passageway on the bottom side; and a distributed gap magnetic material extending beneath the planar winding section and between the first and second planar legs as a column of material extending to the bottom side of the single piece magnetic core.

2. The inductor component assembly of claim 1, wherein the planar winding section of the first conductive winding has a first axial length and the first and second planar legs have a respective second axial length, the second axial length being substantially greater than the first axial length.

3. The inductor component assembly of claim 2, the first conductive winding further comprising first and second planar surface mount termination portions at respective ends of the first and second planar legs opposing the planar winding section.

4. The inductor component assembly of claim 3, wherein the first and second planar surface mount termination portions extend coplanar to one another, perpendicular to the respective first and second planar legs, and in opposing directions to one another.

5. The inductor component assembly of claim 1, wherein the at least one interior passageway comprises a first interior passageway extending between the opposing top and bottom sides and a second interior passageway extending between the opposing top and bottom sides, and the single piece magnetic core further comprises a partition wall extending between the first interior passageway and the second interior passageway.

6. The inductor component assembly of claim 5, further comprising a second conductive winding occupying the second interior passageway, the second conductive winding formed substantially identically to the first conductive winding.

7. The inductor component assembly of claim 6, wherein the second conductive winding is spaced from the first conductive winding on an opposing side of the partition wall to avoid magnetic coupling of the first and second conductive windings when the first and second conductive windings are connected to energized circuitry.

8. The inductor component assembly of claim 1, wherein at least a portion of the first and second planar legs is physically gapped from the single piece magnetic core at a location interior to the at least one interior passageway.

9. The inductor component assembly of claim 1, in combination with the circuit board, the bottom side of the single piece magnetic core located adjacent the circuit board.

10. The inductor component assembly of claim 1, wherein a height dimension of the single magnetic core piece between the top and bottom sides is substantially greater than at least one of a width dimension between the first and second longitudinal sides and a length dimension between the first and second lateral sides.

11. An inductor component assembly for power supply circuitry on a circuit board, the inductor component assembly comprising:

a single piece magnetic core comprising opposing first and second longitudinal side walls, opposing first and second lateral side walls interconnecting the first and second longitudinal side walls, and opposing top and bottom sides interconnecting the respective first and second longitudinal side walls and the respective first and second lateral side walls, wherein a first interior passageway and a second interior passageway extend between the opposing top and bottom sides and a partition wall extends between the first and second interior passageways;

a first conductive winding extending in the first interior passageway;

a second conductive winding extending in the second interior passageway;

wherein each of the first and second conductive windings are substantially identically formed and include a planar winding section exposed on the top side and first and second planar legs each extending perpendicular to the planar winding section and opposing one another, each of the first and second legs protruding from the respective first and second interior passageway on the bottom side; and a distributed gap magnetic material extending beneath the planar winding section of each of the first and second conductive windings as a column of material extending to the bottom side of the single piece magnetic core.

12. The inductor component assembly of claim 11, wherein the single piece magnetic core is not fabricated from a distributed gap material.

13. The inductor component assembly of claim 11, wherein the planar winding section of each first and second conductive windings has a first axial length and the first and second planar legs have a respective second axial length, the second axial length being substantially greater than the first axial length.

14. The inductor component assembly of claim 11, each of the first and second conductive windings further comprising first and second planar surface mount termination portions at respective ends of the first and second planar legs opposing the planar winding section.

15. The inductor component assembly of claim 14, wherein the first and second planar surface mount termination portions extend coplanar to one another, perpendicular to the respective first and second planar legs, and in opposing directions to one another.

16. The inductor component assembly of claim 11, wherein the second conductive winding is spaced from the first conductive winding on an opposing side of the partition wall to avoid magnetic coupling of the first and second conductive windings when the first and second conductive windings are connected to energized circuitry.

17. The inductor component assembly of claim 11, wherein at least a portion of the first and second planar legs is physically gapped from the single piece magnetic core at a location interior to each of the first and second interior passageway.

18. The inductor component assembly of claim 11, in combination with the circuit board, the bottom side of the single piece magnetic core located adjacent the circuit board.

19. A method of fabricating an inductor component assembly for power supply circuitry on a circuit board, the method comprising:

providing a single piece magnetic core that does not possess distributed gap properties, the single piece magnetic core including opposing first and second longitudinal side walls, opposing first and second lateral side walls interconnecting the first and second longitudinal side walls, and opposing top and bottom walls interconnecting the respective first and second longitudinal side walls and the respective first and second lateral side walls, wherein at least one interior passageway extends through and between the opposing first and second sides in spaced relation from the first and second longitudinal walls and in spaced relation from the first and second lateral side walls, and wherein a height dimension of the single magnetic core piece between the top and bottom sides is substantially greater than at least one of width dimension between the first and second longitudinal sides and the length dimension between the first and second lateral sides;

extending a first conductive winding in the at least one interior passageway, wherein the first conductive winding includes a planar winding section exposed on the top side and first and second planar legs each extending perpendicular to the planar winding section and opposing one another, each of the first and second legs protruding from the at least one interior passageway on the bottom side; and applying a distributed gap magnetic material beneath the planar winding section and between the first and second legs as a column of material extending to the bottom side of the single piece magnetic core.

* * * * *